US007134408B2

(12) United States Patent
Diehl et al.

(10) Patent No.: US 7,134,408 B2
(45) Date of Patent: Nov. 14, 2006

(54) DEVICE FOR THE CONTROL OF GAS EXCHANGE VALVES

(75) Inventors: Udo Diehl, Stuttgart (DE); Bernd Rosenau, Asperg (DE); Christian Grosse, Kornwestheim (DE); Simon Kieser, Sachsenheim (DE); Ralph Engelberg, Ditzingen (DE)

(73) Assignee: Robert Bosch GmbH, Stuttgart (DE)

( * ) Notice: Subject to any disclaimer, the term of this patent is extended or adjusted under 35 U.S.C. 154(b) by 249 days.

(21) Appl. No.: 10/488,446

(22) PCT Filed: Mar. 5, 2003

(86) PCT No.: PCT/DE03/00697

§ 371 (c)(1),
(2), (4) Date: Aug. 26, 2004

(87) PCT Pub. No.: WO2004/005679

PCT Pub. Date: Jan. 15, 2004

(65) Prior Publication Data

US 2005/0005881 A1 Jan. 13, 2005

(30) Foreign Application Priority Data

Jul. 6, 2002 (DE) ..... 102 30 478

(51) Int. Cl.
*F01L 9/02* (2006.01)

(52) U.S. Cl. ..... 123/90.12; 123/90.13; 251/12

(58) Field of Classification Search ..... 123/90.12, 123/90.13, 90.15; 251/12, 28, 53
See application file for complete search history.

(56) References Cited

U.S. PATENT DOCUMENTS 6,173,685 B1 1/2001 Sturman
6,321,703 B1 * 11/2001 Diehl et al. ..... 123/90.12

FOREIGN PATENT DOCUMENTS

| | | |
|---|---|---|
| DE | 44 07 585 | 9/1995 |
| DE | 198 26 047 | 12/1999 |
| EP | 0 647 770 | 4/1995 |

* cited by examiner

*Primary Examiner*—Thomas Denion
*Assistant Examiner*—Ching Chang
(74) *Attorney, Agent, or Firm*—Kenyon & Kenyon LLP

(57) ABSTRACT

A device for controlling gas-exchange valves of an internal combustion engine is provided, which device has hydraulic valve actuators each allocated to one gas-exchange valve. Each valve actuator has an actuating piston acting on the gas-exchange valve, and two hydraulic working chambers delimited by the actuating piston, of which the first working chamber acting upon the gas-exchange valve in the closing direction is constantly filled with fluid under pressure, and the second working chamber acting upon the gas-exchange valve in the opening direction is able to be alternately filled with fluid under pressure and relieved via two electric control valves. For the purpose of cost reduction, provided for each valve-actuator pair is a single first electric control valve that is acted upon with the fluid pressure on the intake side, and is connected on the outlet side to the second working chamber of one valve actuator. The second working chamber of the other valve actuator is filled with fluid with the aid of a switchover valve and the fluid pressure in the second working chamber of the one valve actuator.

15 Claims, 2 Drawing Sheets

DEVICE FOR THE CONTROL OF GAS EXCHANGE VALVES

FIELD OF THE INVENTION

The present invention is related to a device for controlling gas-exchange valves in combustion cylinders of an internal combustion engines.

BACKGROUND INFORMATION

In a device disclosed in German patent document 198 26 047, each valve actuator, whose actuating piston is joined in one piece with the valve tappet of the allocated gas-exchange valve, is permanently connected with its first working chamber to a fluid-pressure source delivering fluid under high pressure, and with its second working chamber is connected, on one hand, to a first electric control valve alternately closing or releasing a supply line to the fluid-pressure source, and on the other hand, is connected to a second electric control valve alternately releasing or closing a discharge line leading to a fluid reservoir. The electric control valves are designed as 2/2-way solenoid valves having spring resetting. When the gas-exchange valve is closed, because of the first working chamber connected permanently to the fluid-pressure source, and because of the second working chamber separated from the fluid-pressure source by the first electric control valve and connected to the discharge line by the second electric control valve, the actuating piston of the valve actuator takes its normal position. Both electric control valves are switched over to open the gas-exchange valve. In this manner, on the one hand, the second working chamber of the valve actuator is blocked with respect to the discharge line by the second electric control valve, and on the other hand, is connected by the first electric control valve to the supply line to the fluid-pressure source. Since the actuating-piston surface delimiting the second working chamber in the valve actuator is larger than the actuating-piston surface delimiting the first working chamber, the actuating piston moves out of its normal position, accompanied by reduction in the volume of the first working chamber, and thereby opens the gas-exchange valve. The size of the opening lift is a function of the formation of the electric control signal applied to the first electric control valve, and the opening speed is a function of the fluid pressure applied from the fluid-pressure source. To maintain the gas-exchange valve in a specific open position, the first electric control valve is subsequently switched over, so that it blocks the supply line to the second working chamber of the valve actuator. In this way, all open positions of the gas-exchange valve may be adjusted by an electric control unit for generating control signals. The gas-exchange valve is closed by resetting the second electric control valve into its open position, so that the first working chamber of the valve actuator is again connected to the discharge line. To control a gas-exchange valve, in each case two electric control valves are necessary which act upon the second working chamber of the allocated valve actuator with fluid pressure, or relieve it of pressure, accordingly.

SUMMARY

The device of the present invention for controlling gas-exchange valves has the advantage that, by replacing the first electric control valve of one of the valve actuators in the valve-actuator pair by a simple switchover valve, via which the fluid pressure in the second working chamber is controlled with the aid of the fluid pressure at hand in the second working chamber of the other valve actuator, the number of electric control valves per valve-actuator pair is reduced. Furthermore, according to an example embodiment of the invention, a second electric control valve in the valve-actuator pair may be replaced by a simple check valve which connects the second working chamber of the one valve actuator to the second electric control valve allocated to the other valve actuator, and it is then possible to save on two solenoid valves per valve-actuator pair. Since the electric control valves, usually constructed as 2/2-way solenoid valves, must realize extremely small switching times, in practice approximately 0.3 ms given an opening cross-section of 3 $mm^2$, such electric control valves are very costly, so that the reduction in the number of electric control valves in the control device is accompanied by a marked cost savings. Due to the lower number of electric control valves, the number of output stages and the expenditure on electric cabling for these control valves are also reduced, which reduction leads to a further cost savings. The smaller number of electric control valves also reduces the electric energy demand and lowers the probability of the device malfunctioning. Because of the smaller unit volume of a simple switchover valve compared to a solenoid valve, the installation space required for accommodating the device in the vehicle may also be reduced. The valve-actuator pair, controlled by a single first electric control valve and by two or only one second electric control valve, includes such valve actuators which are used for actuating two gas-exchange valves of the same kind, thus two intake valves or two exhaust valves, in the same combustion cylinder.

According to one example embodiment of the invention, the switchover valve is positioned in a connecting line between the two working chambers of the two valve actuators of the valve-actuator pair. If the switchover valve, designed as a 2/2-way valve able to be actuated either electromotively, electromagnetically or hydraulically, is deblocked, then the second working chamber of the one valve actuator is supplied with fluid pressure via the second working chamber of the other valve actuator, and therefore the actuating piston of the valve actuator is shifted in the direction of opening the gas-exchange valve. By suitably selecting the instant for deblocking the switchover valve, it is possible to realize different opening times of the gas-exchange valve actuated by this valve actuator, or to keep this gas-exchange valve closed, if necessary. The single first electric control valve in the valve-actuator pair may be designed so that, in the extreme case, it is able to regulate the entire volumetric flow which both valve actuators of a valve-actuator pair need to execute a simultaneous or staggered, but always parallel, stroke. Different closing times may be realized at both gas-exchange valves via the triggering of the second electric control valves. If, as observed above, one of the two second electric control valves is replaced by a check valve, then the gas-exchange valves are closed at the same point of time.

According to one example embodiment of the invention, the switchover valve is a hydraulically actrated 2/2-way valve having two hydraulic control inputs, and is designed so that a valve deblocking takes place only when both control inputs are acted upon. The one control input is linked to the second working chamber connected to the single first electric control valve, and the other control input is linked to the outlet of a further switchover valve acted upon on the input side by a fluid pressure. The second working chamber of the valve actuator connected to the switchover valve is connected via the switchover valve directly to the fluid-pressure source. As soon as the single first electric control valve is triggered, the fluid pressure input by it into the second working chamber is also available at the one control input of the switchover valve. The switchover valve may then be deblocked at any point in time by acting upon the second control input; with the switching of the switchover valve, fluid flows directly from the fluid-pressure source into the second working chamber of the other valve actuator. This example embodiment has the advantage that the single first electric control valve in the valve pair only has to be dimensioned for the supply of a single valve actuator, and does not have to switch the entire fluid quantity for triggering both valve actuators. In addition, unsteadiness in the lifting movement of the one valve actuator, which may be produced during the stroke of its actuating piston by the switching in of the other valve actuator and by the additional fluid requirement of the second working chamber of the following valve actuator thus occurring, is avoided.

According to one example embodiment of the invention, all switchover valves of the existing valve pairs are deblocked by the further switchover valve, so that only a single further switchover valve is present in the device, which results in reduction in production costs and installation space.

According to one example embodiment of the invention, the further switchover valve is acted upon by fluid pressure by linking its valve intake via a check valve to the second working chamber of the valve pair, the second working chamber being connected to the single first electric control valve. Alternatively, the further switchover valve may be acted upon by pressure through an external fluid-pressure source, e.g., the low-pressure circuit of the internal combustion engine.

DETAILED DESCRIPTION

Figure 1:
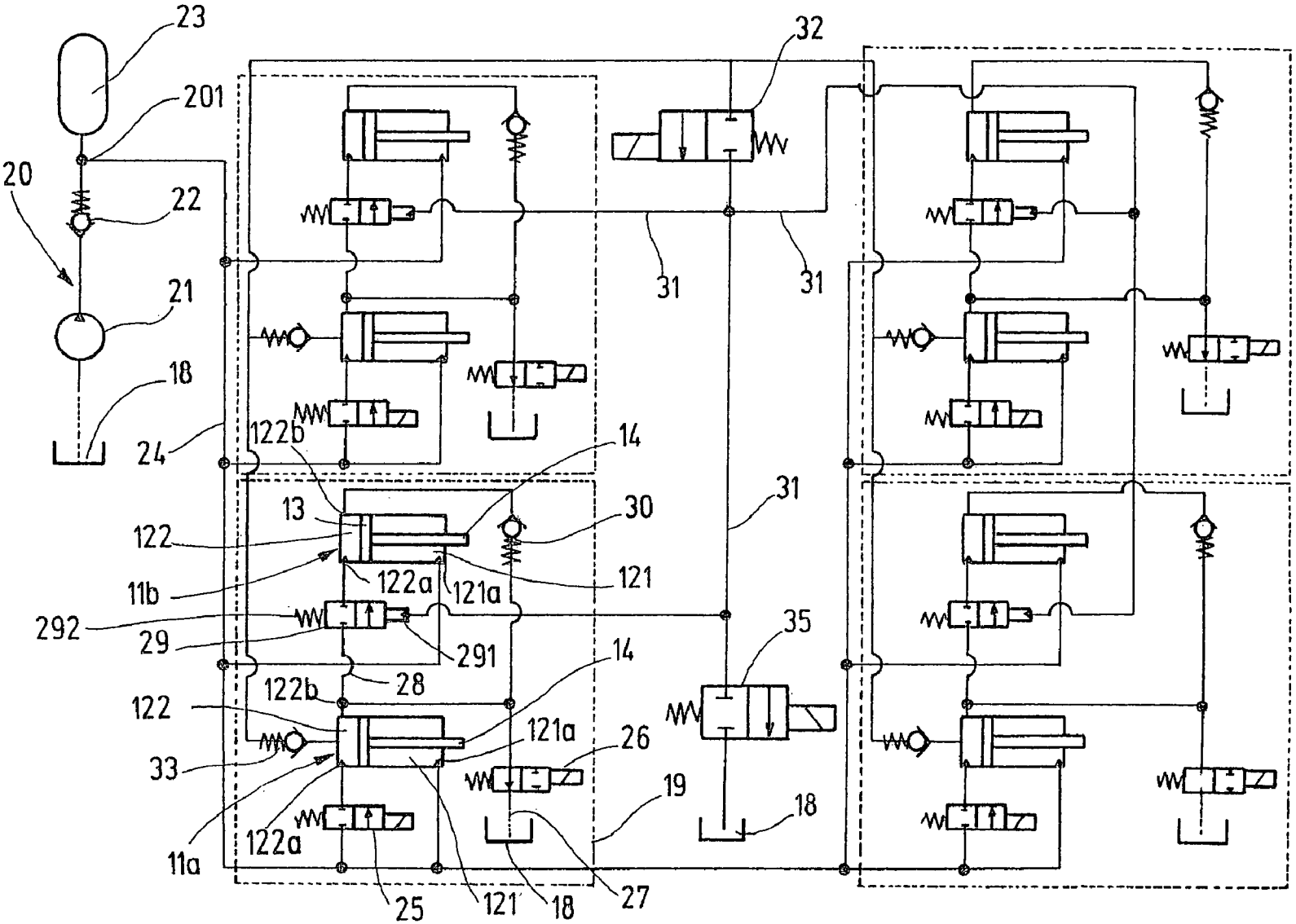
FIG. 1 shows a circuit diagram of a device for controlling eight gas-exchange valves arranged in four different combustion cylinders of a four-cylinder internal combustion engine.
Figure 3:
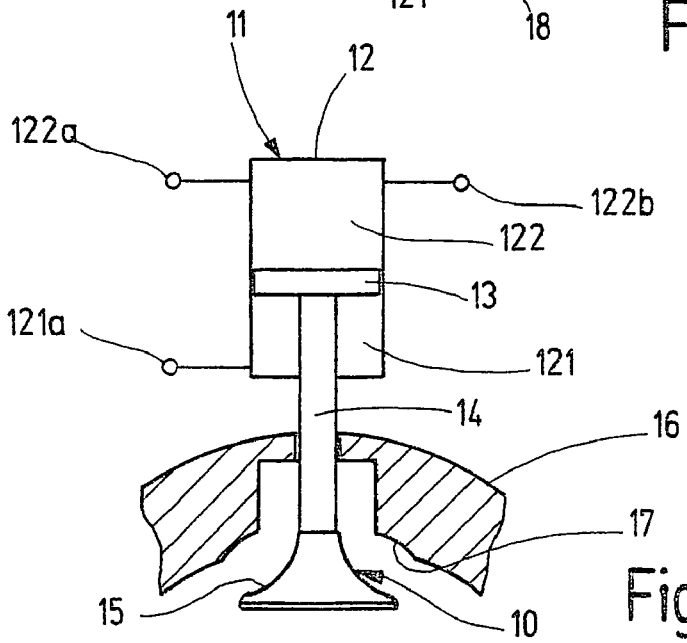
FIG. 3 shows a schematic representation of a gas-exchange valve, connected to a valve actuator, in a combustion cylinder of the internal combustion engine.

The device for controlling gas-exchange valves in combustion cylinders of an internal combustion engine, as shown in FIG. 1, is designed for the control of a total of eight gas-exchange valves 10, like one shown schematically in FIG. 3, of which two are arranged in each combustion cylinder of a four-cylinder/four-stroke internal combustion engine. Gas-exchange valves 10 may be the intake valves or the exhaust valves in the combustion cylinders. The device according to the present invention includes a plurality of hydraulic valve actuators 11, e.g., in the exemplary embodiment a total of eight valve actuators 11, each of which actuates one gas-exchange valve 10. Each valve actuator 11 has a working cylinder 12 in which an actuating piston 13 is guided in an axially displaceable manner. Actuating piston 13 divides working cylinder 12 into two hydraulic pressure or working chambers 121 and 122, and is fixedly joined to a valve tappet 14 of gas-exchange valve 10. FIG. 3 shows schematically in enlarged representation a valve actuator 11 in connection with an open gas-exchange valve 10. At its end turned away from actuating piston 13, valve tappet 14 bears a valve sealing surface 15 that cooperates with a valve seat surface that is formed in cylinder head 16 of the combustion cylinder of the internal combustion engine, for controlling an opening cross-section. Working cylinder 12 has a total of three hydraulic connections, of which two hydraulic connections 122*a* and 122*b* discharge in the upper pressure chamber or second working chamber 122, and one hydraulic connection 121*a* discharges in the lower pressure chamber or first working chamber 121.

The device also has a pressure-supply device 20, whose output 201 forms a fluid-pressure source for supplying valve actuators 11. Pressure-supply device 20 includes a high-pressure pump 21 that delivers fluid from a fluid reservoir 18, a check valve 22 positioned on the outlet side at high-pressure pump 21, and an accumulator 23 for pulsation damping and energy storage. Output 201 of pressure-supply device 20, which is tapped between check valve 22 and accumulator 23, is connected via a line 24 to hydraulic connections 121*a* of first working chambers 121 in all of the total of eight valve actuators 11, so that first working chambers 121 of valve actuators 11 are constantly acted upon by high fluid or hydraulic pressure available at output 201 of pressure-supply device 20.

Of the total of eight existing valve actuators 11, in each case two valve actuators 11 are combined to form a valve-actuator pair, which in each instance control two intake valves or two exhaust valves in the same combustion cylinder. The allocated combustion cylinder is symbolized in FIG. 1 by dotted edging 19 of the valve-actuator pair with the associated control means. To simplify the description, valve actuators 11 of one valve-actuator pair are designated in the following by 11*a* and 11*b*, and the description is limited only to one valve-actuator pair allocated to one combustion cylinder. However, the following description holds true in the same manner for the remaining three valve-actuator pairs allocated to the remaining combustion cylinders.

Fluid connection 122*a* of second working chamber 122 of valve actuator 11*a* is linked via a first electric control valve 25, formed as a 2/2-way solenoid valve having spring resetting, to line 24 leading to output 201 of pressure-supply device 20, while fluid connection 122*b* of second working chamber 122 of valve actuator 11*a* is connected to a second electric control valve 26 likewise formed as a 2/2-way solenoid valve with spring resetting. On the output side, second electric control valve 26 is connected to a return line 27 discharging into fluid reservoir 18. Fluid connection 122*a* of second working chamber 122 of valve actuator 11*b* is connected to fluid connection 122*b* at valve actuator 11*a* via a connecting line 28, in which is arranged a hydraulically deblockable switchover valve 29 having spring resetting. Fluid connection 122*b* of second working chamber 122 of valve actuator 11*b* is likewise connected via a check valve 30 to the intake of second electric control valve 26. Switchover valve 29 has a hydraulic control input 291 that is connected via a control line 31 to the outlet of a further switchover valve 32 able to be actuated electromagnetically. On the intake side, further switchover valve 32 is connected via a check valve 33 to second working chamber 122 of valve actuator 11*a*.

Figure 2:
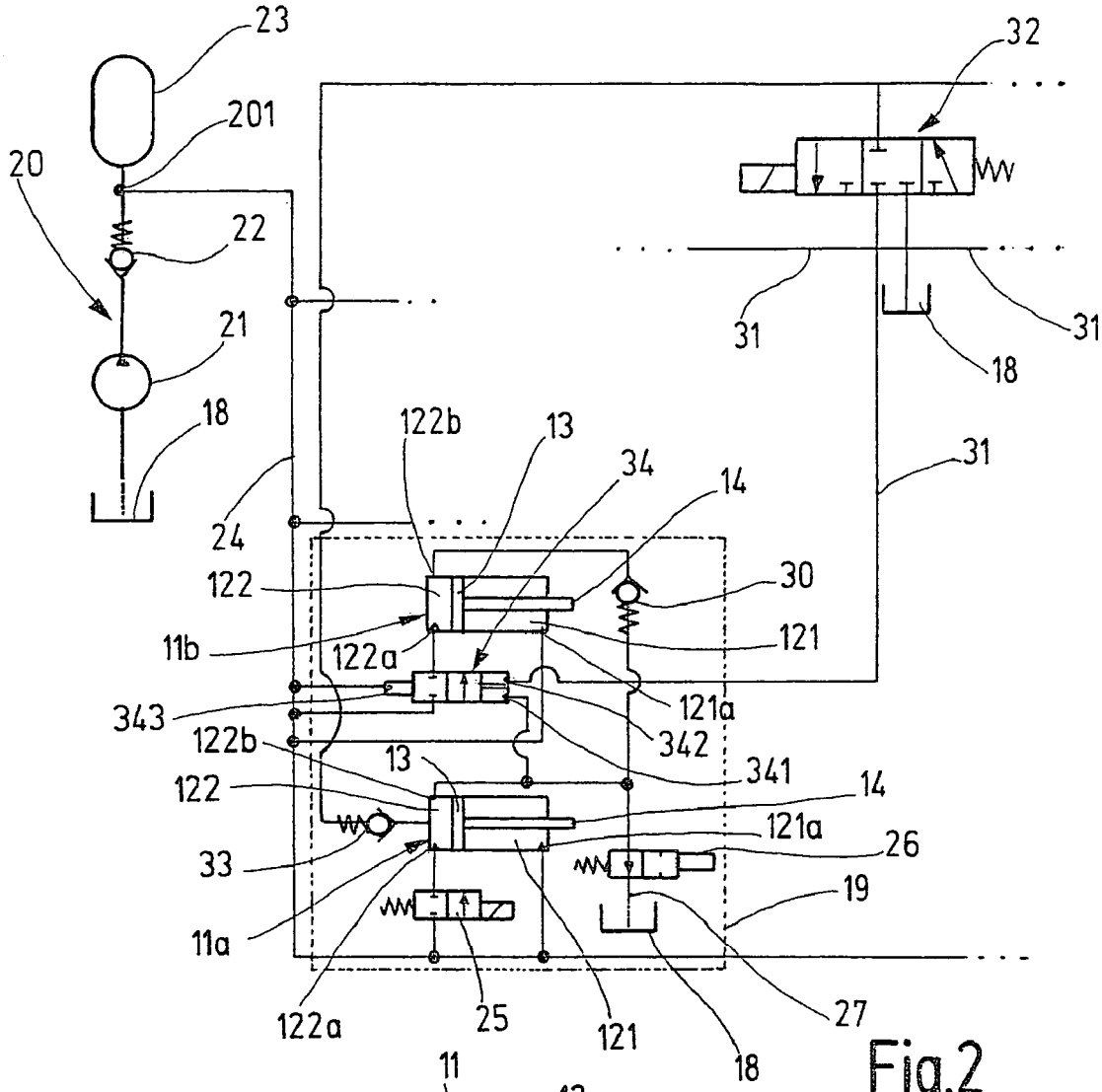
FIG. 2 shows a circuit diagram of a modified device for controlling the gas-exchange valves.

Alternatively, however, the intake side of further switchover valve 32 may also be connected to output 201 of pressure-supply device 20 or to a low-pressure circuit of the internal combustion engine. The outlet side of further switchover valve 32 is connected via corresponding control lines 31 to all control inputs 291 of switchover valves 29 for all valve-actuator pairs. If, as in the exemplary embodiment of FIG. 1, switchover valve 32 is constructed as a 2/2-way solenoid valve with spring resetting, then for the relief of control line 31, a discharge valve 35 formed as a 2/2-way solenoid valve with spring resetting must also be provided, whose one valve connection is connected to control line 31, and whose other valve connection is connected to fluid reservoir 18. This discharge valve 35 may be omitted if switchover valve 32 is constructed as a 3/3-way solenoid valve having spring resetting as shown in FIG. 2. In this case, of the three valve connections, the valve intake is linked via check valve 33 again to second working chamber 122 of valve actuator 11*a* and to output 201 of pressure-supply device 20, respectively, and a first valve outlet is connected to control line 31, and a second valve outlet is connected to fluid reservoir 18.

With closed gas-exchange valves 10, valve actuators 11*a* and 11*b* of a valve-actuator pair take their normal position in which first electric control valve 25 blocks second working chamber 122 of valve actuator 11*a* from output 201 of pressure-supply device 20, and second electric control valve 26 links second working chamber 122 of valve actuator 11*a* to return line 27. Second working chamber 122 of valve actuator 11*b* is likewise connected to return line 27 via check valve 30 and open second electric control valve 26. Due to the resetting action of their resetting springs, both switchover valves 29, 32 take their blocking position. Because of the system pressure prevailing in first working chamber 121, actuating piston 13 is shifted maximally into its normal position and, via valve tappet 14, holds gas-exchange valve 10 closed. In the exemplary embodiment shown, control valves 25, 26 are currentless, and switchover valve 29 is pressureless.

To open gas-exchange valves 10, first of all, second electric control valve 26 is transferred into its closed or shut-off position, so that the two second working chambers 122 of both valve actuators 11*a* and 11*b* are closed. Discharge valve 35 is put into its closed position. At the same time, first electric control valve 25 is put into its working or open position, so that second working chamber 122 of valve actuator 11*a* is connected to pressure-supply device 20, and the system pressure available at output 201 of pressure-supply device 20 is now also available in second working chamber 122 of valve actuator 11*a*. Since the surface of actuating piston 13 delimiting first working chamber 121 is smaller than the surface of actuating piston 13 delimiting second working chamber 122, a displacement force develops which moves actuating piston 13 in FIG. 1 to the right, whereby gas-exchange valve 10 is opened. The size of the opening lift of gas-exchange valve 10 is a function of the opening duration and the opening speed of first electric control valve 25.

If, at a point of time thereafter or simultaneously with first electric control valve 25, further switchover valve 32 is triggered, it then deblocks switchover valve 29, in that the system pressure reaching control input 291 of switchover valve 29 via check valve 33 and opened further switchover valve 32 switches over switchover valve 29 against the force of the resetting spring. Thus, fluid from second working chamber 122 of valve actuator 11*a* will flow into second working chamber 122 of valve actuator 11*b*, and its actuating piston 13 is displaced in the direction of valve opening. Since the entire fluid stream is now flowing via first electric control valve 25, it is necessary that first electric control valve 25 be designed for the maximum volumetric flow through both valve actuators 11*a* and 11*b*. After second valve actuator 11*b* is switched in, gas-exchange valve 10 actuated by this valve actuator 11*b* moves in accordance with the triggering of first electric control valve 25, so that actuating pistons 13 of both valve actuators 11*a* and 11*b*—depending upon the instant of the deblocking of switchover valve 29—execute a simultaneous or staggered, parallel stroke.

To retain gas-exchange valves 10 in their open position, first electric control valve 25 is again switched over (in the exemplary embodiment of FIG. 1, de-energized), so that it separates second working chamber 122 of valve actuator 11*a* from line 24 to pressure-supply device 20.

If gas-exchange valves 10 are to be closed again after a certain opening time, then second electric control valve 26 is also switched over (in the exemplary embodiment of FIG. 1, de-energized), so that it links working chambers 122 of both valve actuators 11*a* and 11*b* to return line 27. Due to the system pressure in first working chambers 121 of valve actuators 11*a* and 11*b*, actuating pistons 13 in working cylinders 12 of both valve actuators 11*a* and 11*b* are returned to the normal position shown in FIG. 1, gas-exchange valves 10 thereby being closed with the same closing times.

If different closing times are sought to be realized, then check valve 30 is to be replaced by a further second electric control valve 26 which is likewise constructed as a 2/2-way solenoid valve and is to be connected on the intake side to second working chamber 122 of valve actuator 11*b*, and on the output side directly to return line 27.

Instead of hydraulically deblockable switchover valve 29 between the two second working chambers 122 of both valve actuators 11*a* and 11*b*, a switchover valve able to be deblocked electromotively or electromagnetically may also be used. Further switchover valve 32 may also be replaced by an electric actuator which directly deblocks all switchover valves 29 electromotively or likewise hydraulically.

As shown in a partial diagram in FIG. 2, another embodiment of the device for controlling gas-exchange valves in combustion cylinders of an internal combustion engine is modified in comparison to the device shown in FIG. 1 insofar as switchover valve 29 in FIG. 1, with connecting line 28 between second working chambers 122 of both valve actuators 11*a* and 11*b*, is replaced by a hydraulically controlled switchover valve 34, via which second working chamber 122 of valve actuator 11*b* is connected directly with line 24 to output 201 of pressure-supply device 20. Switchover valve 34, which is designed as an "AND gate", has two hydraulic control inputs 341, 342, which must both be acted upon by a hydraulic pressure for the switching of switchover valve 34. Switchover valve 34 also possesses a hydraulic reset input 343 to which a hydraulic pressure is applied for switching the switchover valve 34 into the closed or blocking position shown in FIG. 2, and to that end, is connected to line 24 to output 201 of pressure-supply device 20. One control input 341 of switchover valve 34 is connected to fluid connection 122*b* of second working chamber 122 of valve actuator 11*a*, and the other control actuator 11*a* due to the additional fluid requirement of valve actuator 11*b*, is avoided.

The above description applies to the further valve pairs, (not shown in FIG. 2), for the other combustion cylinders of the internal combustion engine in the case of the control device according to FIG. 2, as well. input 342 is connected via control line 31 to electrically controlled further switchover valve 32. Electrically controlled switchover valve 32 is constructed here as a 3/3-way solenoid valve having spring resetting, whose second valve outlet is connected to fluid reservoir 18. Depending upon the position of the 3/3-way solenoid, valve, pressure may be built up, retained, or reduced in control line 31. However, switchover valve 32 may also be constructed as a 2/2-way solenoid valve as in FIG. 1. In this case, in the same way as in FIG. 1, discharge valve 35 constructed as a 2/2-way solenoid valve is also to be retained. Moreover, in this case, the switching device according to FIG. 2 is unchanged, so that the same components are provided with the same reference numerals.

Given pressure at hand in second working chamber 122 of valve actuator 11*a*, control input 341 is hydraulically loaded, so that at any point in time thereafter switchover valve 34 may be deblocked by the triggering of further switchover valve 32. With the deblocking of switchover valve 34, fluid flows directly from line 24 into second working chamber 122 of valve actuator 11*b*, and actuating piston 13 in working cylinder 12 of valve actuator 11*b* is shifted in a parallel stroke with respect to actuating piston 13 in, working cylinder 12 of valve actuator 11*a*, so that gas-exchange valve 10 actuated by valve actuator 11*b* is opened accordingly. In this modified control device, first electric control valve 25 only has to be dimensioned to supply valve actuator 11*a* with fluid, since valve actuator 11*b* is supplied directly by pressure-supply device 20. At the same time, unsteadiness in the lifting movement of valve actuator 11*a*, which may be produced when working with the control device according to FIG. 1 in response to the switching in of valve actuator 11*b* during the travel of valve

What is claimed is:

1. A device for controlling gas-exchange valves in combustion cylinders of an internal combustion engine, comprising:

at least two hydraulic valve actuators, each valve actuator being allocated to a corresponding gas-exchange valve;

an actuating piston assigned to each valve actuator and acting on the corresponding gas-exchange valve;

a first electric control valve;

a second electric control valve; and a switch-over valve adapted to be switched between a blocking position and a pass-through position;

wherein two hydraulic working chambers are defined by the actuating piston and the interior of the corresponding valve actuator, a first working chamber acting on the corresponding gas-exchange valve in the closing direction being constantly filled with a fluid under pressure by connection to a fluid-pressure source, and a second working chamber acting on the corresponding gas-exchange valve in the opening direction, the second working chamber being adapted to be filled with the fluid under pressure with the aid of a first electric control valve connected on its intake side to the fluid-pressure source and adapted to be relieved of fluid to a low-pressure level with the aid of a second electric control valve connected on an outlet side of the first electric control valve;

wherein, for the two valve actuators, the first electric control valve is connected on its outlet side to the second working chamber of a first one of the two valve actuators, and the second working chamber of a second one of the two valve actuators is filled with fluid with the aid of the switch-over valve and with the aid of the fluid pressure in the second working chamber of the first one of the two valve actuators, whereby the second working chamber of the second one of the two valve actuators is connected to the first electric control valve.

2. The device according to claim 1, wherein the two valve actuators are assigned to two gas-exchange valves of the same type in a single combustion cylinder, the two gas-exchange valves being one of exhaust valves and intake valves.

3. The device according to claim 1, wherein the switch-over valve is positioned in a connecting line between the second working chamber of the first valve actuator and the second working chamber of the second valve actuator.

4. The device according to claim 3, wherein the switch-over valve is a 2/2-way valve adapted to be actuated one of electromotively and electromagnetically.

5. The device according to claim 3, wherein the switch-over valve is a hydraulically actuated 2/2-way valve and has a control input connected to a valve outlet of a further switch-over valve acted upon by a fluid pressure.

6. The device according to claim 5, wherein the 2/2-way valve has a resetting spring for returning to the blocking position.

7. The device according to claim 5, wherein for applying fluid pressure to the further switch-over valve, valve intake of the further switch-over valve is connected via a check valve to the second working chamber of one of the two valve actuators, the second working chamber being connected to the first electric control valve.

8. The device according to claim 7, wherein the further switch-over valve is constructed as a 2/2-way solenoid valve having spring resetting, and wherein a discharge valve is connected to an outlet of the further switch-over valve, the discharge valve being a 2/2-way solenoid valve having spring resetting, and wherein a connection to a fluid reservoir is produced by the discharge valve.

9. The device according to claim 7, wherein the further switch-over valve is a 3/3-way solenoid valve having spring resetting, and wherein a second valve outlet of the 3/3-way solenoid valve is connected to a fluid reservoir.

10. The device according to claim 7, wherein the connection of the valve intake of the further switch-over valve is made to the two valve actuators.

11. The device according to claim 5, wherein at least two valve actuators are provided for each combustion cylinder, and the further switch-over valve is connected on its outlet side to each hydraulic switch-ever valve allocated to a corresponding pair of valve actuators.

12. The device according to claim 1, wherein the switch-over valve is a hydraulically actuated 2/2-way valve having two hydraulic control inputs, and wherein the switch-over valve is only deblocked if both control inputs are acted upon, and wherein a first control input is connected to the second working chamber of the first of the two valve actuators, the second working chamber being connected to the first electric control valve, and wherein a second control input is connected to an outlet of a further switch-over valve acted upon on its intake side by a fluid pressure, and wherein the switch-over valve is connected on its intake side to the fluid-pressure source and connected on its outlet side to the second working chamber of the second of the two valve actuators.

13. The device according to claim 12, wherein the 2/2-way valve has a hydraulic resetting control input for resetting into the blocking position, and wherein the resetting control input is connected to the fluid-pressure source.

14. The device according to claim 1, wherein the second electric control valve has its valve intake linked directly to the second working chamber of the first one of the two valve actuators, the second working chamber being connected to the first electric control valve, and wherein the valve intake of the first electric control valve is linked by a check valve to the second working chamber of the second one of the two valve actuators.

15. The device according to claim 1, wherein for the two valve actuators, two second electric control valves are provided, and wherein each second electric control valve is connected on its intake side to the second working chamber of at least one of the two valve actuators.

* * * * *